US005189935A

United States Patent [19]

Rosemann

[11] Patent Number: 5,189,935

[45] Date of Patent: Mar. 2, 1993

[54] ROTARY CUTTING DIE ASSEMBLY

[76] Inventor: Richard Rosemann, 456 S. Clay, Kirkwood, Mo. 63122

[21] Appl. No.: 820,309

[22] Filed: Jan. 9, 1992

Related U.S. Application Data

[63] Continuation-in-part of Ser. No. 611,075, Nov. 9, 1990, abandoned.

[51] Int. Cl.[5] ..... B26D 7/26

[52] U.S. Cl. ..... 83/343; 83/346; 83/663; 83/698

[58] Field of Search ..... 83/343, 346, 659, 663, 83/673, 674, 675, 698

[56] References Cited

U.S. PATENT DOCUMENTS

| | | | |
|---|---|---|---|
| 3,566,734 | 3/1971 | Robinson | 83/346 |
| 3,683,734 | 8/1972 | Claussen | 83/343 |
| 4,420,999 | 12/1983 | Hirakawa et al. | 83/343 |

*Primary Examiner*—Hien H. Phan

*Attorney, Agent, or Firm*—Rogers, Howell & Haferkamp

[57] ABSTRACT

A rotary cutting die assembly comprised of a mandrel adapted to be rotatably mounted in a rotary die cutting press, and a cylindrical cutting sleeve and drive gear slip fit over the mandrel, provide a method and apparatus for replacing the cutting edge of a rotary cutting die at a reduced cost for materials, manufacturing and shipping than that associated with conventional rotary cutting die replacement.

15 Claims, 1 Drawing Sheet

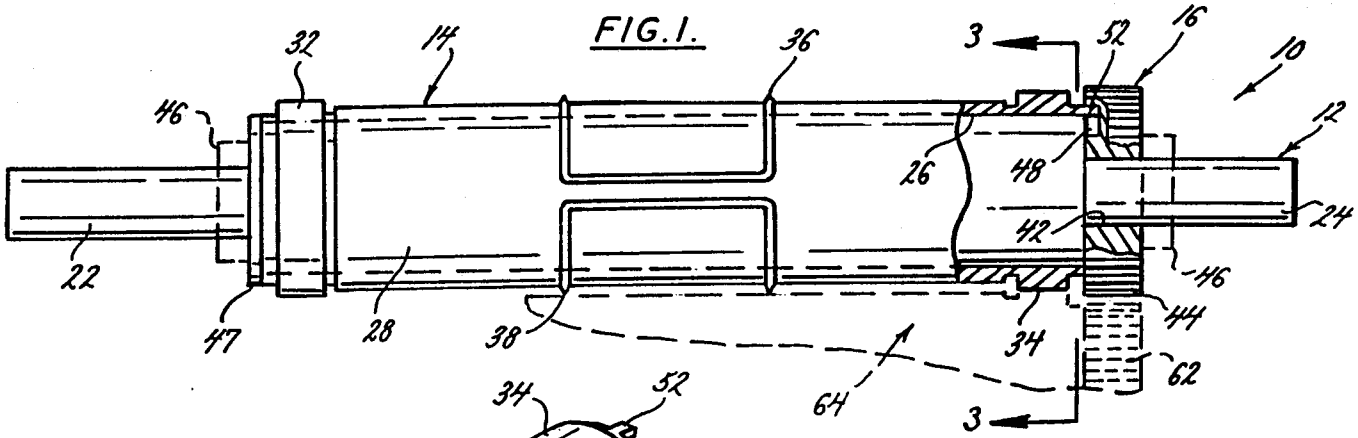
FIG. 1.
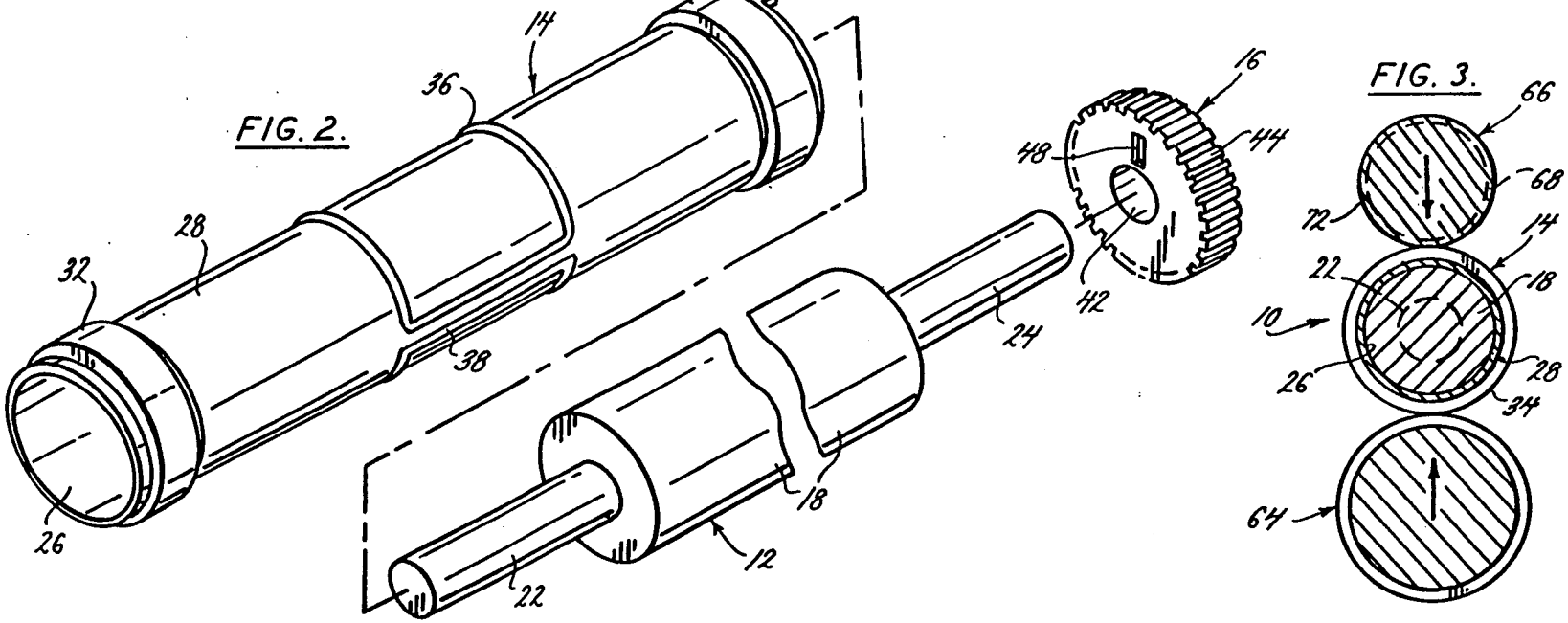
FIG. 2.
FIG. 3.

ROTARY CUTTING DIE ASSEMBLY

This application is a continuation-in-part of application Ser. No. 07/611,075, filed on Nov. 9, 1990, and now abandoned.

BACKGROUND OF THE INVENTION (1) Field of the Invention

The present invention relates to a rotary cutting die assembly that is comprised of separable component parts. In particular, the invention pertains to a rotary cutting die assembly comprised of a mandrel having a cutting cylinder and drive gear slip fit thereon. The drive gear is connected in driving engagement with the sleeve and both move relative to the mandrel during cutting operations performed by the assembly. The cutting cylinder is deformable on the mandrel while performing the cutting operations of the assembly and is replaceable when worn. The rotary cutting die assembly of the present invention enables reductions in material costs, heat treatment costs, and shipping costs from those costs associated with manufacturing and distributing conventional rotary cutting dies.

(2) Description of the Related Art

Prior art rotary cutting die presses commonly employ a rotating cutting die and a rotating anvil roll mounted parallel to the cutting die on the press. Mating gears connected with the cutting die and the anvil roll cause the die and roll to rotate in synchronism with each other. The cutting die and anvil roll rotate against each other as stock material or a web of stock is passed through the press between the rotating die and anvil. A pressure assist roll or a load carrying truck or tractor assembly is often employed to exert a downward force on the die and cause it to bear against the anvil roll. As the material passes between the rotating die and anvil, a cutting configuration formed on the exterior surface of the cutting die cuts sections of material from the web. The shape of the sections of material cut from the web correspond to the configuration of the cutting edges of the die.

Self adhesive labels or pressure sensitive labels and other similar articles are commonly provided in rolls of such labels. The rolls are made up of a plurality of self stick labels attached to a continuous length of backing material. The self stick labels are readily removed from the rolls of backing material by merely peeling the labels from the material.

Rotary production of pressure sensitive labels is accomplished by passing a web of pressure sensitive label stock comprising the label material, a layer of pressure sensitive adhesive, and a backing layer to which the adhesive holds the label, material, between a rotary cutting die and a smooth anvil roll rotatably mounted on a die cutting press. As set forth above, the cutting die has an exterior cylindrical surface with cutting edge configurations formed thereon. The configuration of the die cutting edges is determined in accordance with the shapes desired of the labels to be cut from the label stock. As the label stock is passed between the cutting die and the anvil roll of the press, labels are produced by crush cutting through the label material and the layer of pressure sensitive adhesive, to the backing layer of the stock. The cutting die does not cut through the backing layer and the above described operation forms a continuous sheet of self adhesive labels that may be removed from the backing.

Rotary cutting dies of the type used in preparing label strips are commonly formed from a solid steel cylinder. The cylinder is large enough in diameter to provide a peripheral surface area sufficient in size to accommodate several cutting edge configurations required for a desired label shape or set of label shapes to be cut from label stock. The diameter of the cylinder is also chosen to provide sufficient strength to the cylinder to prevent any deflection of the cylinder during rotary cutting operations of the press.

The cutting edge configurations are typically engraved on the exterior surface of the rotary cutting die by various methods such as mechanical milling, chemical milling or spark erosion. The dies are also formed with journal shafts protruding from their opposite ends. The journal shafts are used in mounting a gear on the rotary cutting die, and for rotatably mounting the die in a rotary die cutting press. The gear mounted on the shaft is fixed stationary relative to the cutting die and meshes with a gear of the press to impart rotation to the cutting die. The gear mounted on the die meshes with a gear on the anvil roll of the press to deliver a rotational force to the anvil roll and to maintain the rotary cutting die, the anvil roll, and other operations performed by the rotary cutting press in synchronism.

The opposite ends of the cutting die, just inside of the journal shafts, are formed with a cylindrical bearing surface having a diameter that is equal to or slightly greater than the diameter of the peripheral surfaces of the cutting edges. These opposite surfaces of the die form bearing rolls. The bearing rolls maintain constant the distance of the anvil roll axis from the cutting die axis for proper mesh of the cutting die gear and the anvil gear of the press and for controlling the distance of the die's cutting edges from the anvil roll.

A variation of the above described prior art cutting die provides an undercut magnetic area between the bearing rolls of the cutting die. The area is undercut to accept a flexible steel sheet having the desired cutting edge configurations engraved thereon.

Rotary cutting dies of the type described above are disadvantaged in that they are expensive to manufacture, and correspondingly expensive to replace when worn. Because the diameter of a rotary cutting die must be made large enough to both prevent center deflection of the die during a cutting operation and to provide adequate surface area for the plurality of cutting edge configurations desired on the die, a significant materials cost is involved in the manufacture of a rotary cutting die. Because the cost of heat treating a die is based on the weight of the die, the more material used in manufacturing the die correspondingly increases the costs involved in heat treating the die. Moreover, because shipping costs are directly related to the weight of the product being shipped, the costs involved in delivering the cutting dies to purchasers is also directly related to the weight of materials involved in manufacturing the die.

Accordingly, it would be advantageous to provide a method of making a rotary cutting die as an assembly of component parts, where one component part of the assembly comprising the cutting edge configurations is separable from the remainder of the assembly after a period of wear, and is replaceable by a new component part. Such an assembly would reduce the materials cost involved in manufacturing an entire rotary cutting die to replace a die whose cutting edges have worn. Such an assembly would also reduce the heat treatment costs, which are based on weight, involved in manufacturing a replacement rotary cutting die in that only the component part being replaced need be heat treated.

Such an assembly would also reduce the shipping costs involved in replacing a worn rotary cutting die in that only the component part replacing the worn component part need be shipped.

The present invention overcomes the problems associated with conventional rotary cutting dies by providing a rotary cutting die assembly comprised of several component parts, with each component part being separable from the assembly and replaceable, thereby reducing the costs of material, heat treatment, and shipping associated with replacing an entire worn rotary cutting die of the prior art.

SUMMARY OF THE INVENTION

The rotary cutting die assembly of the present invention is generally comprised of three component parts. The cutting die includes a mandrel, a cutting sleeve, and a drive gear. The component parts of the cutting die assembly are adapted to be assembled on a rotary cutting die press of the type employing an anvil roll, against which the rotary cutting die assembly of the present invention bears.

The mandrel is generally a cylinder of solid material. A center portion of the mandrel cylinder has a constant diameter across its entire axial length. Left and right side journal shafts project outward from opposite ends of the center portion of the mandrel. The journal shafts are cylindrical and also have substantially constant diameters along their entire axial lengths. The diameters of the journal shafts are reduced from the diameter of the mandrel center portion and are dimensioned to be rotatably received in bearings of the rotary cutting die press.

The cutting edge configurations of the die assembly of the present invention are formed on an exterior surface of the cylindrical cutting sleeve of the present invention. The sleeve itself is formed as a hollow cylinder and has a substantially constant inner diameter across its axial length. The sleeve also has a substantially constant outer diameter across its axial length, except for the raised edges of the cutting configurations formed on the exterior surface of the sleeve and a pair of cylindrical bearing rolls formed on opposite ends of the sleeve. The configuration of the die sleeve cutting edges is determined according to the shapes desired of the labels to be cut from label stock by the die assembly.

The diameter of the peripheral surface of the bearing rolls is equal to or slightly greater than the diameter of the peripheral surface of the cutting edges formed on the cutting sleeve. The bearing rolls maintain a constant distance between the axis of the assembly cutting sleeve and the axis of the press anvil roll, and maintain constant the distance between the cutting edge configurations of the sleeve and the exterior surface of the anvil roll.

The interior diameter of the cutting sleeve is dimensioned to enable the sleeve to be slip fit over the center portion of the mandrel and to be movable relative to the mandrel. The thickness of the sleeve wall is chosen to enable the sleeve to deform slightly on the mandrel when the assembly of the invention is employed in cutting operations in a cutting press of the type having an anvil roll opposed by a pressure assist roll or a load carrying truck or tractor assembly, and the sleeve is compressed between the anvil roll and the pressure assist roll or load carrying truck or tractor assembly.

The drive gear of the assembly is provided with a center bore dimensioned to enable the gear to be slidably received over an end journal shaft of the mandrel and to be movable relative to the mandrel. The drive gear positively engages with the cylindrical cutting sleeve mounted on the mandrel center portion, and meshes with a gear on the anvil roll or a gear of the cutting press on which the cutting die assembly is mounted. The drive gear delivers a rotational force to the cutting sleeve rotating the sleeve independent of the mandrel and maintains the rotary cutting assembly, the anvil roll, and other operations performed by the rotary cutting press in synchronism.

The rotating cutting die assembly of the present invention is unique in that the cutting edge configurations and bearing rolls of the assembly are machined onto a thin walled cylindrical sleeve that is slip fit on the mandrel. The cutting edges formed on the cylindrical cutting sleeve are subject to wear during use of the invention in cutting operations. A cutting sleeve with worn edges is removable from the mandrel and replaceable by a new sleeve. The cutting sleeves represent a small percentage of the total weight of the rotary cutting die assembly, and the material costs, heat treatment costs, and shipping costs involved in the manufacture and replacement of the cutting cylinder sleeve are significantly less than those involved in replacing an entire rotary cutting die of the prior art.

BRIEF DESCRIPTION OF THE DRAWINGS

Further objects and features of the present invention are revealed in the following detailed description of the preferred embodiment of the invention and in the drawings figures wherein:

FIG. 1 is an assembled view, partially in section, of the rotary cutting die assembly of the present invention;

FIG. 2 is an exploded perspective view of the separate component parts that make up the rotary cutting die assembly of the present invention; and FIG. 3 is an end elevation view of the rotary cutting die assembly of the present invention taken along the line 3—3 of FIG. 1 and showing the assembly in operation between an anvil roll and a pressure assist roll of a die cutting press.

DESCRIPTION OF THE PREFERRED EMBODIMENT

FIG. 1 shows the rotary cutting die assembly 10 of the present invention. The assembly is generally comprised of a mandrel 12, a cylindrical cutting sleeve 14, and a drive gear 16.

The mandrel 12 is constructed with three separate sections. A middle section or portion 18 of the mandrel has a cylindrical exterior surface. The diameter of the middle section 18 is substantially constant across the entire axial length of the section. Left and right journal shaft sections or portions 22, 24 extend axially from opposite ends of the mandrel middle section 18. The journal shaft sections are concentric with the mandrel middle section. The left and right journal shafts 22, 24 also have substantially constant diameters along their axial length. The shaft diameters are both equal and are reduced from the diameter of the mandrel middle section 18. The diameter dimensions of the left and right journal shafts 22, 24 are determined to enable the shafts to be rotatably mounted on a conventional die cutting press, thereby rotatably mounting the mandrel 12 on the press.

The cylindrical cutting sleeve 14 has a hollow cylindrical bore through its entire axial length, providing the sleeve with an interior surface 26 and an exterior surface 28. The sleeve interior surface 26 has a substantially constant diameter across the entire axial length of the sleeve. The dimensions of the interior diameter of the sleeve are determined to enable the sleeve 14 to be removably slip fit over the exterior surface of the mandrel middle section 18. The difference between the diameter of the exterior surface of the mandrel middle section 18 and the diameter of the interior surface 26 of the sleeve provides a limited clearance of the order of one to thirty thousandths of an inch between the sleeve interior and the mandrel exterior. This limited clearance, and the thin wall of the cylinder that forms the sleeve 14, allow the sleeve to deform to an oblong cross section configuration when employed in cutting operations of a rotary die cutting press.

The exterior surface 28 of the cutting sleeve 14 is also cylindrical. The sleeve exterior has a substantially constant diameter across the entire axial length of the sleeve, except for a pair of bearer rolls 32, 34 formed at opposite ends of the sleeve and the cutting edge configurations 36, 38 formed on the sleeve surface.

The cutting edge configurations 36, 38 may be formed over the exterior surface of the cutting sleeve 14 by any known method of forming cutting edge configurations on rotary cutting dies. Although only two cutting edge configurations are shown on the sleeve in drawing FIGS. 1 and 2, it should be understood that in actual use of the cutting sleeve 14 of the present invention a plurality of cutting edge configurations will be formed on the external surface of the sleeve 14 to make the most efficient use of the sleeve surface area available and to cut as many labels from label stock passed through a rotary cutting die press employing the assembly of the present invention.

The bearer rolls 32, 34 are the load carrying surfaces of the cylinders 14. The rolls have cylindrical exterior surfaces that are raised from the exterior surface 28 of the cutting sleeve 14. The diameters of the exterior surfaces of the bearer rolls 32, 34 are equal to or slightly greater than the diameter of the peripheral surface of the cutting edge configurations 36, 38 formed on the exterior surface of the sleeve. The diameter dimensions of the bearer rolls 32, 34 are chosen to maintain the proper spacing of the sleeve 14 center axis and the axis of the anvil roll of a rotary cutting press employing the assembly of the invention. The diameter dimensions of the bearer rolls 32, 34 also maintain a desired distance between the cutting edges 36, 38 of the cutting edge configurations on the sleeve 14 and the surface of the anvil roll of the cutting press with which the assembly of the invention is employed.

The drive gear 16, having a bore 42 at its center and gear teeth 44 formed around its periphery, is slip fit on the right end journal shaft 24 of the mandrel. The gear 16, like the cutting sleeve 14, is removably slip fit on the mandrel 12 and both the sleeve and gear are capable of rotating on the mandrel. The gear is slip fit on the right journal shaft 24 and abuts against the right end of the mandrel middle section 18 as is best seen in FIG. 1. In one embodiment, the gear 16 engages in friction engagement with the right most end of the cutting sleeve 14 as viewed in FIG. 1, to provide a positive driving engagement between the gear and the cutting sleeve. The gear 16 may be held in its axial position on the shaft 24 by a conventional clamp 46 shown in phantom lines in FIG. 1. The clamp prevents axial movement of the gear 16 on the shaft and maintains the friction engagement of the left side of the gear with the right side of the sleeve 14. A disc 47 having an outside diameter larger than the inside diameter of the sleeve 14 is slip fit on the left end journal shaft 22 and abuts against the left end of the mandrel middle section 18. The disc 47 is held in its axial position on the shaft 22 by a conventional clamping collar 46 shown in phantom lines in FIG. 1. The collar 46 and disc 47 prevent the sleeve 14 from sliding off the left end of the mandrel middle section 18 and maintain the positive driving engagement between the right side of the sleeve 14 and the left side of the drive gear 16. In this arrangement, the sleeve 14 must extend to the right a slight distance beyond the mandrel middle section to avoid friction engagement between the left side of the gear and the mandrel middle section. The sleeve 14 is held in its position relative to the mandrel middle section 18 and the drive gear 16 by the two clamps 46 and the disc 47. Other methods of providing a positive mechanical engagement between the driving gear 16 and the cutting sleeve 14 may be employed in lieu of the friction engagement.

In the preferred embodiment of the invention, a slot 48 is formed in the left hand side of the drive gear 16 as shown in the drawing figures. The slot 48 extends radially through the left side of the drive gear 16 and stops short of the center bore 42 of the drive gear and the gear teeth 44 of the drive gear. The radial length of the slot 48 is determined to allow for the full range of movement of the sleeve 14 on the mandrel 16 as the sleeve is deformed during cutting operations performed by the rotary cutting die assembly 10. The slot 48 is shown in the drawing figures as being formed directly into the left hand side of the drive gear 16 and is an integral part of the drive gear. In alternate embodiments, other methods may be employed in providing a radially extending slot on the side of the drive gear positioned adjacent the cylinder 14 when the cylinder and drive gear are assembled on the mandrel.

The right hand edge of the cylinder 14 as shown in the drawing figures is provided with an axially projecting pin or projection 52. The pin 52 is provided to engage in the slot 48 of the gear 16 when the sleeve 14 and gear 16 are assembled on the mandrel 12. The engagement of the pin 52 in the slot 48 provides a positive driving engagement between the gear 16 and the sleeve 14 that enables both the gear and sleeve to rotate in synchronism relative to the mandrel. The radial length of the slot 48 is provided to enable the pin 52 to reciprocatingly slide through the slot in response to the deformation of the sleeve 14 to an oblong cross section during cutting operations as will be explained. As seen in FIG. 1, a conventional clamp 46 may be attached to the journal shaft 24 adjacent the gear 16. Together, the clamp 46 and disc 47 on the left end shaft 22 and the clamp 46 on the right end shaft 24 maintain the relative axial positions between the gear 16 and the sleeve 14 and maintain the engagement of the sleeve pin 52 in the gear slot 48. Although only one drive gear 16 is shown connected to the right side of the sleeve 14 in FIG. 1, the sleeve 14 may be modified with projecting pins 52 at opposite ends of the sleeve to enable a pair of drive gears to be mounted on both journal shafts 22, 24 and connected in driving engagement with the opposite left and right hand ends of the sleeve 14. The mounting of a second drive gear on the left end shaft 22 and the pin and slot engagement of the second gear with the left end of the sleeve 14 is substantially identical to that of the drive gear 16 described above. When a second drive gear is mounted on the left end shaft 22 the disc 47 is not needed and is removed.

The teeth 44 of the drive gear 16 mesh with teeth 62 of a gear on the anvil roll 64 of the cutting press (shown in phantom lines) with which the assembly of the invention is employed. The meshing of the drive gear 16 with the anvil roll gear of the cutting press delivers rotational force to the cylindrical cutting sleeve and maintains a synchronous rotating movement of the cylindrical cutting sleeve 14 with the anvil roll of the press as well as maintaining a registry of the cutting sleeve rotation with other operations performed by the cutting press. Alternatively, the drive gear 16 may mesh with a driving pinion gear of the press (not shown) to impart rotation to the drive gear 16 and the sleeve 14.

The assembly of the component parts of the invention is basically as shown in FIG. 2 of the drawing figures. The cylindrical cutting sleeve 14 is slipped over one end of the mandrel 12 and is slip fit over the middle section 18 of the mandrel. The drive gear 16 is then slipped over the journal shaft 24 projecting from the mandrel middle section 18 and is moved along the journal shaft until it is positioned adjacent the end of the mandrel middle section 18. The projecting pin 52 of the sleeve 14 is inserted into the slot 48 of the drive gear 16 as the gear is positioned on the shaft 24 to provide a positive driving engagement between the gear and the sleeve 14 mounted on the mandrel middle section. The assembled rotary cutting die assembly of the present invention is then mounted on a rotary cutting die press in much the same manner as a conventional, one piece, rotary cutting die.

FIG. 3 shows an end view in section of the relative positions of the rotary cutting die assembly 10 of the present invention and an anvil roll 64 and pressure assist roll 66 of a rotary die cutting press. The upper pressure assist roll 66 is adjusted to bear downward against the die assembly 10 of the invention, causing it to bear against the lower anvil roll 64 to ensure uniform cutting of the label stock passed between the die assembly 10 of the invention and the lower anvil roll 64. The top pressure assist roll 66 has an undercut middle section 68 and cylindrical bearings 72 at opposite sides of the middle section that bear downward against the bearer rolls 32, 34 of the cutting sleeve 14 and force the cutting die assembly 10 downward against the lower anvil roll 64. Although a pressure assist roll is shown in FIG. 3, it should be understood that the present invention is equally well suited for use with a cutting press employing a load carrying truck or tractor or other force applying means. The bearer rolls 32, 34 also engage in rolling contact with the lower anvil roll 64, and between the upper pressure assist roll 66 and lower anvil roll 64, the cylindrical cutting sleeve 14 is slightly deformed into an almost imperceptible oblong shape as viewed in FIG. 3 due to the slight difference in the diameter of the sleeve interior 26 and the diameter of the mandrel middle section 18. The deformation of the sleeve is so slight that the sleeve returns to its circular cross section once the force of the pressure assist roll 66 and anvil roll 64 are removed.

The deformation of the cylindrical cutting sleeve 14 on the mandrel 12 in response to cutting operations performed by the rotary cutting die assembly by a rotary die cutting press is needed to transfer the forces exerted by the bearings 72 of the pressure assist roll 66 to the cutting edge configurations 36, 38 of the sleeve 14. As the sleeve deforms to its oblong cross section configuration in response to the forces of the pressure assist roll being exerted on the bearer rolls 32, 34 of the sleeve, the interior surface 26 of the sleeve contacts both the top of the mandrel midsection 18 and the bottom of the mandrel midsection as viewed in FIG. 3. The deformation to the oblong shaped cross section of the sleeve causes the left and right sides of the sleeve interior surface 26 viewed in FIG. 3, to bow apart from the mandrel midsection 18 and slightly separate from the midsection. Because the separation is so slight it is not visible in drawing FIG. 3. The contact of the sleeve interior surface 26 along both the top of the mandrel midsection 18 and the bottom of the mandrel midsection transmits the forces exerted on the bearer rolls 32, 34 of the sleeve by the bearings 72 of the pressure assist roll 66 vertically through the center of the mandrel middle section 18 to the bottom of the sleeve as viewed in FIG. 3, and exerts these forces on the cutting edge configurations 36, 38 of the sleeve as they pass beneath the mandrel middle section 18 and between the mandrel 12 and the lower anvil roll 64. This deformation of the sleeve 14 and the contact of the top and bottom interior surfaces 26 of the sleeve with the top and bottom exterior surfaces of the mandrel middle section 18 enables the force of the pressure assist roll 72 exerted on the top of the sleeve to be transferred through the sleeve and the mandrel to the cutting edge configurations 36, 38 as they cut into web material passed between the mandrel and the anvil roll 64.

As the sleeve 14 is deformed to its oblong configuration during cutting operations performed by the rotary cutting die assembly, the positive driving engagement between the pin 52 and the slot 48 enables the sleeve 14 to rotate with the gear 16 in a one to one relationship, maintaining the synchronous rotation of the sleeve 14 and the cutting edge configurations 36, 38 formed on the sleeve with the anvil roll 64 and other operations of the press. Although the rotary cutting die assembly of the present invention is described as being employed in a cutting press having a pressure assist roll 66 and an anvil roll 64 compressing the cylinder 14 of the assembly therebetween, it should be understood that this description of the operation of the invention is illustrative only and, the rotary cutting die assembly 10 of the present invention is equally well suited for use in rotary die cutting presses other than that shown.

The cutting edge configurations 36, 38 of the cutting sleeve 14 are critical portions of the die cutting assembly 10 of the invention that wear in use. Accordingly, it is only the cylindrical cutting sleeve 14 that need be replaced when the cutting edges 36, 38 of the sleeve are sufficiently worn, as opposed to replacing the entire rotary cutting die of the prior art. The savings in material involved in replacing the cutting sleeve of the assembly as opposed to replacing an entire rotary cutting die of the prior art should be readily apparent. The cutting sleeve represents a small percentage of the total weight of the rotary cutting die assembly, and the material costs, heat treatment costs, and shipping costs involved in the manufacture and replacement of the cutting sleeve are significantly less than those involved in replacing an entire rotary cutting die of the prior art.

While the present invention has been described by reference to a specific embodiment, it should be understood that modifications and variations of the invention may be constructed without departing from the scope of the invention defined in the following claims.

What is claimed is:

1. A rotary cutting die assembly for performing cutting operations of a rotary die cutting press, the assembly comprising:

a mandrel having an exterior surface and means for mounting the mandrel on a rotary die cutting press;

a hollow cylindrical sleeve having an exterior surface and in interior surface, the sleeve having at least one cutting edge on the exterior surface, the sleeve being received on the mandrel for movement of the sleeve relative to the mandrel;

a drive gear received on the mandrel for movement of the drive gear relative to the mandrel, the drive gear being connected in a driving engagement with the cylindrical sleeve to cause the sleeve to move relative to the mandrel in response to the drive gear moving relative to the mandrel;

the sleeve has opposite first and second ends, and the drive gear is received on the mandrel adjacent to the sleeve and engaging in driving engagement with one of the first and second ends of the sleeve;

a radial slot is provided on a side of the drive gear adjacent to the sleeve; and an axial pin is provided on said one of the first and second ends of the sleeve, the pin extends into the slot on the drive gear thereby connecting the drive gear in driving engagement with the sleeve.

2. The die assembly of claim 1, wherein:

the pin is received in the slot for radial movement of the pin in the slot.

3. A rotary cutting die assembly for performing cutting operations of a rotary die cutting press, the assembly comprising:

a mandrel having an exterior surface and means for mounting the mandrel on a rotary die cutting press;

a hollow cylindrical sleeve having an exterior surface and an interior surface, the sleeve having at least one cutting edge on the exterior surface, the sleeve being received on the mandrel for movement of the sleeve relative to the mandrel;

a drive gear received on the mandrel for movement of the drive gear relative to the mandrel, the drive gear being connected in a driving engagement with the cylindrical sleeve to cause the sleeve to move relative to the mandrel in response to the drive gear moving relative to the mandrel;

the mandrel has a cylindrical exterior surface with a first cross section diameter; and, the sleeve has a cylindrical interior surface with a second cross section diameter larger than the first cross section diameter, and a difference between the first cross section diameter of the mandrel and the second cross section diameter of the sleeve interior surface enables the sleeve to deform on the mandrel to an oblong cross section of the sleeve interior surface in response to the sleeve being compressed between a pressure assist roll and an anvil roll of a rotary die cutting press.

4. The die assembly of claim 3, wherein:

the cylindrical sleeve and the drive gear are mounted on the mandrel for free rotation of the sleeve and the drive gear relative to the mandrel, and the sleeve and the drive gear are connected in driving engagement preventing relative rotation between the sleeve and the drive gear on the mandrel.

5. A rotary cutting die assembly for performing cutting operations of a rotary die cutting press, the assembly comprising:

a mandrel having an exterior surface and means for mounting the mandrel on a rotary die cutting press adjacent to an anvil roll of the press;

a hollow cylindrical sleeve having an exterior surface and an interior surface, the sleeve being received on the mandrel for movement of the sleeve relative to the mandrel, the sleeve having at least one cutting edge on the exterior surface and having a pair of bearer rolls on the exterior surface at opposite ends of the sleeve, the bearer rolls being pressed between forces exerted by the anvil roll and forces exerted by a force applying means of the press during cutting operations performed with the rotary cutting die assembly by a rotary die cutting press;

a drive gear received on the mandrel for movement of the drive gear relative to the mandrel, the drive gear being connected in a driving engagement with the cylindrical sleeve; and, the drive gear has a side adjacent to one of the opposite ends of the cylindrical sleeve, a slot is provided on the side of the drive gear, and a pin projects from one of the opposite ends of the sleeve and engages in the slot, thereby connecting the drive gear in driving engagement with the cylindrical sleeve and preventing relative rotation between the drive gear and sleeve on the mandrel to the drive gear.

6. The die assembly of claim 5, wherein:

the slot extends radially on the side of the drive gear and the pin extends axially into the slot, the slot thereby enabling the pin to move radially relative to the drive gear while preventing the pin from rotating relative to the drive gear.

7. The die assembly of claim 5, wherein:

the mandrel has a cylindrical exterior surface with a first cross section diameter; and the sleeve has a cylindrical interior surface with a second cross section diameter larger than the first cross section diameter, and a difference between the first cross section diameter of the mandrel exterior surface and the second cross section diameter of the sleeve interior surface enables the sleeve to deform on the mandrel to an oblong cross section of the sleeve interior surface in response to the sleeve being compressed between a pressure assist roll and an anvil roll of a rotary die cutting press.

8. A rotary cutting die assembly for performing cutting operation of a rotary die cutting press, the assembly comprising:

a mandrel having a cylindrical exterior surface and having means for mounting the mandrel on a rotary die cutting press, the cylindrical exterior surface of the mandrel having a first cross section diameter;

a hollow sleeve having a cylindrical exterior surface and a cylindrical interior surface, the sleeve having at least one cutting edge on the cylindrical exterior surface, the cylindrical interior surface of the sleeve having a second cross section diameter larger than the first cross section diameter, and the sleeve being received over the mandrel exterior surface; and a difference between the first cross section diameter of the mandrel exterior surface and the second cross section diameter of the sleeve interior surface enabling the sleeve to deform on the mandrel to an oblong cross section of the sleeve in response to the sleeve being compressed between a pressure assist roll and an anvil roll of a rotary die cutting press.

9. The die assembly of claim 8, wherein:

a drive gear is received on the mandrel and means are provided between the drive gear and the sleeve for connecting the drive gear and the sleeve.

10. The die assembly of claim 9, wherein:

the sleeve is received over the mandrel exterior surface for rotation of the sleeve on the mandrel, the drive gear is received on the mandrel for rotation of the drive gear on the mandrel, and the means for connecting the drive gear and the sleeve prevents rotation of the drive gear relative to the sleeve.

11. The die assembly of claim 9, wherein:

the cylindrical sleeve and the drive gear are received on the mandrel for free rotation of both the sleeve and the drive gear relative to the mandrel, and the means for connecting the drive gear and the sleeve causes the drive gear and sleeve to rotate in synchronism.

12. The die assembly of claim 9, wherein:

the cylindrical sleeve has axially opposite ends and the drive gear is received on the mandrel adjacent one of the opposite ends of the sleeve, a side of the drive gear adjacent the sleeve has a slot thereon and the one end of the sleeve has a projection that engages in the slot, thereby providing the means for connecting the drive gear and the sleeve.

13. The die assembly of claim 12, wherein:

the slot extends radially on the side of the drive gear and the projection engages in the slot for radially reciprocating movement of the projection in the slot.

14. The die assembly of claim 12, wherein:

the engagement of the projection in the slot enables the sleeve to deform on the mandrel to an oblong cross section of the sleeve while enabling the sleeve and the drive gear to rotate in synchronism.

15. The die assembly of claim 12, wherein:

the drive gear is a unitary gear with the slot formed therein and the cylindrical sleeve is a unitary sleeve with the projection formed thereon.

* * * * *